US005122919A

United States Patent [19]

Takemae et al.

[11] Patent Number: 5,122,919

[45] Date of Patent: Jun. 16, 1992

[54] LINER FOR FLOPPY DISK JACKET

[75] Inventors: Sigeru Takemae; Akira Aoki; Youichi Sakai, all of Nagoya, Japan

[73] Assignee: Mitsubishi Rayon Co., Ltd., Tokyo, Japan

[21] Appl. No.: 443,437

[22] Filed: Nov. 30, 1989

[30] Foreign Application Priority Data

Oct. 18, 1989 [JP] Japan ..... 1-271113

[51] Int. Cl.[5] ..... G11B 23/03

[52] U.S. Cl. ..... 360/133; 206/313; 428/900

[58] Field of Search ..... 360/133; 206/444, 313, 206/312; 428/900

[56] References Cited

U.S. PATENT DOCUMENTS 4,414,597 11/1983 Cornin ..... 360/133
4,586,606 5/1986 Howey ..... 206/313
4,610,352 9/1986 Howey et al. ..... 206/313
4,655,348 4/1987 Takagi ..... 360/133 X

FOREIGN PATENT DOCUMENTS 0085683 5/1986 Japan ..... 206/313
61-258057 11/1986 Japan .

*Primary Examiner*—Andrew L. Sniezek
*Attorney, Agent, or Firm*—Oblon, Spivak, McClelland, Maier & Neustadt

[57] ABSTRACT

A liner for a floppy disk comprising a partially thermocompression-bonded nonwoven fabric composed of a cellulosic fiber and a polyester, core-sheath type conjugated fiber wherein the melting point of the sheath component is lower than that of the core component, in which the mixture ratio of the conjugated fiber decreases gradually from the inner part toward the outer part of the liner, and parts heat-bonded in a dot or in a line through the conjugated fiber are present in a large number in the non thermocompression-bonded parts.

2 Claims, 1 Drawing Sheet

LINER FOR FLOPPY DISK JACKET

BACKGROUND OF THE INVENTION

1. Field of the Invention

The present invention relates to the improvement of a liner for a floppy disk jacket.

2. Prior Art

The floppy disk used for data processing in computers is generally protected with a hard case jacket molded from ABS resins or a jacket formed of vinyl chloride resins provided with a liner on the inside thereof.

The importance of the liner is very great in respect of avoiding the abrasion or damage of the disk surface and of cleaning the disk surface, and a variety of liners have hitherto been proposed.

For example, U.S. Pat. Nos. 4,586,606 and 4,610,352, and Japanese Patent Application Kokai (Laid-open) No. 61-258057 propose liners in which a non-thermoplastic fiber such as rayon and cotton is provided onto the surface which contacts with the disk to obtain a liner construction little abrasive to the disk, and a thermoplastic fiber such as low melting point polyester fiber and nylon 6 fiber is provided to the intermediate layer and is partially thermo-compression-bonded to maintain the fabric strength of the liner.

The basic idea of the prior art method mentioned above is to prevent the formation of abrasion dust of the liner due to its contact with the disk and thus eliminate the disturbance of information transmission at the read-write head of the disk drive of a computer, and for this purpose a non-thermoplastic fiber is provided onto the surface which contacts with the disk to obtain a liner structure little abrasive to the disk. The crucial problem of liners of above prior art is that they are poor in form stability.

The "form stability" referred to herein not only means the ability to maintain a tensile strength required in providing the liner to a jacket formed of vinyl chloride resin or ABS resin, but also involves the form stability in various environments (temperatures and humidities) in which the floppy disk is used in practice, and the form stability to dimensional creep developed when a nonwoven fabric is cut under a tension and then the fabric is released from the tension.

When the liners of prior art are viewed from such points, they are very poor in form stability in various environments. The change in form due to environment (i.e. temperature and humidity) specifically means such physical change as the shrinkage or elongation in longitudinal or lateral direction, or the increase or decrease in thickness, of the liner. When the shrinkage in longitudinal or lateral direction of a liner occurs for example in a jacket for a 3.5" floppy disk, it will press down the lifter (a part which plays a very important role in maintaining the rotatory torque and in cleaning) fitted to the jacket of the floppy disk, causing an abnormal lowering of torque and decrease of cleaning effect, which is an important function of a liner, and thus greatly impairs the function of the floppy disk. Conversely, when the elongation of a liner occurs, it will cause the contact of the liner with the disk at other parts than the lifter part, leading to an abnormal increase of torque. In the case of 8" or 5.25" floppy disks, the dent or the collapse of the jacket will occur owing to the difference in shrinkage (or difference in elongation) between the vinyl chloride resin jacket and the liner.

The change in thickness of a liner also causes similar results. Although the stability of a liner to environmental changes is thus of great importance, no consideration whatever has been given to this point in the liner design of the prior art.

SUMMARY OF THE INVENTION

The object of the present invention is to provide a liner for a floppy disk which is excellent in environmental stability.

The present invention discloses a liner for a floppy disk comprising a partially thermo-compression-bonded nonwoven fabric composed of a cellulosic fiber and a polyester, core-sheath type conjugated fiber wherein the melting point of the sheath component is lower than that of the core component, in which the mixture ratio of said conjugated fiber decreases gradually from the inner part toward the outer part of the liner, and parts heat-bonded in a dot or in a line through said conjugated fiber are present in a large number in the non thermocompression-bonded parts.

(1) : the side which contacts with a disk (the surface),
(2) : the side which contacts with a jacket (the back),
(3) : non thermocompression-bonded part,
(4) : thermocompression-bonded part,
(12)–(15) : parts heat-bonded in a dot or in a line.

DESCRIPTION OF THE PREFERRED EMBODIMENT

The present invention will be described in detail below with reference to the Drawings.

Figure 1:
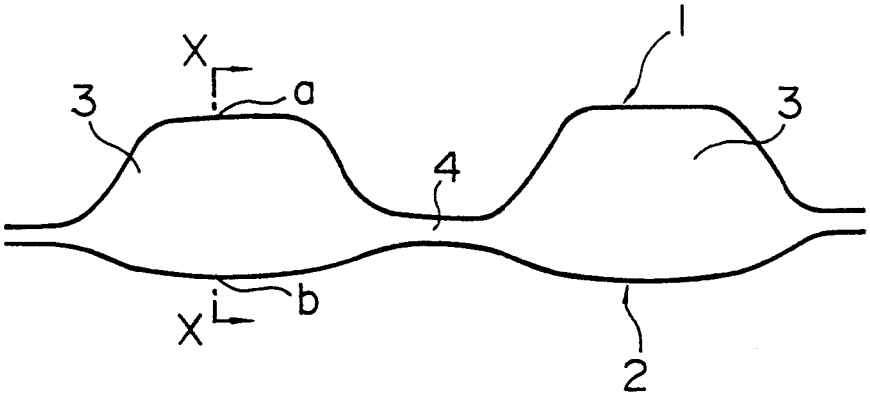
FIG. 1 is a sectional view showing an example of the liner according to the present invention.

FIG. 1 is a partially enlarged view of the cross section of a liner having a large number of partially thermocompression-bonded parts, numeral 1 indicating the side which contacts with a disk (the surface), 2 the side which contacts with a jacket (the back), 3 a non thermocompression-bonded part, and 4 a thermocompression-bonded part.

Figure 2:
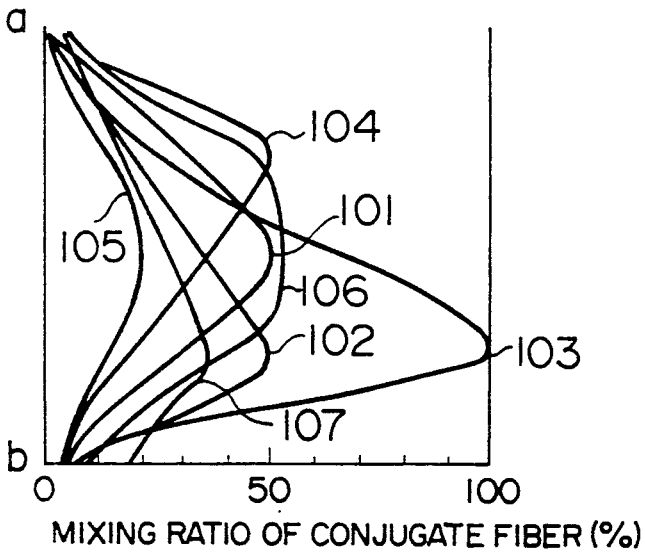
FIG. 2 is a graph showing various examples of the distribution of mixture ratio of polyester, core-sheath type conjugated fiber at the cross section taken along the line x—x' in FIG. 1.

FIG. 2 shows examples of the distribution of mixture ratio of polyester, core-sheath type conjugated fiber (hereinafter sometimes referred to simply as conjugated fiber) at the cross section of the non thermocompression-bonded part 3 of the liner shown in FIG. 1 taken along the line x—x', the points of intersection of the line x—x' with the surface and the back of the liner being put as a and b, respectively.

Figure 3:
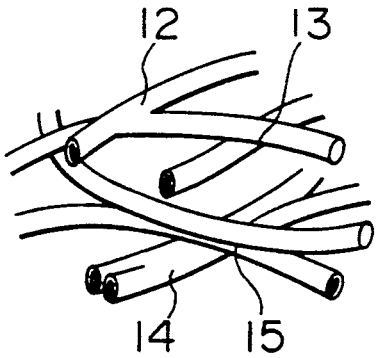
FIG. 3 is a partially enlarged view showing the state of fibers heat-bonded with each other in a dot or in a line, in the non thermocompression-bonded part 3 of FIG. 1.

FIG. 3 is a partially enlarged view showing the state of heat-bonding in a dot or in a line through the conjugated fiber, in the non thermocompression-bonded part.

In the liner according to the present invention, the distribution of mixture ratio of conjugated fiber at the cross section of the non thermocompression-bonded part 3 of the liner having a large number of partially thermocompression-bonded parts 4 shows a gradual decrease from the inner part toward the outer part as shown in FIG. 2, and there exist a large number of places where the non thermocompression-bonded part is heat-bonded in a dot or in a line through the conjugated fiber as shown in FIG. 3.

The first requisite of the present invention is that there exist even in the non thermocompression-bonded part a large number of places heat-bonded in a dot or in a line. In the prior art liner, even when a large number of partially thermocompression-bonded parts are provided, the fibers constituting the non thermocompression-bonded part are not constrained with each other, so that the non thermocompression-bonded parts are of a structure easily affected by temperature and humidity (i.e. environment). In the present invention, even in the non thermocompression-bonded part a large number of places heat-bonded in a dot or in a line through conjugated fibers exist, so that the fibers in the non thermocompression-bonded part are constrained with each other and the liner assumes a structure hardly affected by temperature and humidity. Although the bonding in the form of dot or line in the non thermocompression-bonded part may conceivably effected also by adhesion with resin or the like without resorting to the heat bonding through conjugated fiber as in the present invention, such a method is not favorable because it gives rise to much risk of falling off of the adhered substance onto the disk or sticking thereof to the disk.

The heat bonding in a dot or in a line referred to herein includes, as shown in FIG. 3, a case (indicated by numeral 12) wherein the conjugated fiber is heat-bonded with each other or with a cellulosic fiber at their intersecting point to an extent which gives an indistinct interface, a case (13) wherein the heat bonding is effected to give a distinctly observable interface at the intersecting point, or cases wherein the heat bonding is effected in a limited length of less than fiber length and to give an indistinct interface (14) or to give a distinctly observable interface (15), and even in a heat bonding effected in a line, its length is 10 mm at the longest. Thus, it is essentially different from an overall thermocompression-bonding observed in partially thermocompression-bonded parts. The heat bonding in a dot or in a line not only increases the form stability of a liner to temperature and humidity changes, but also maintains its flexibility by developing a so-called pantograph structure in the non thermocompression-bonded part and further can increase the durability of elasticity of the non thermocompression-bonded part to pressures from the outside exerted, for example, by a lifter in a 3.5" floppy disk and by a pressure pad in a 8" and 5.25" floppy disk. Moreover, since mutual dislocation of fibers can be prevented during the punching process of a liner in the fabrication step of a floppy disk, the punching (cutting) processability is improved and the flash and fluff at the punched part are decreased.

The second requisite of the present invention is that the distribution of mixture ratio of the conjugated fiber shows a gradual decrease from the inner part toward the outer part of the liner.

Although the conjugated fiber is an indispensable material for maintaining the form stability of the liner, it is on the other hand inherently liable to give damage to the disk, so that it is necessary to distribute the fiber more in the inner part of the liner and less in the outer part. The mixture ratio of the conjugated fiber in the outer part of the liner should be less than 10% when its adverse effect on the disk is taken into consideration.

The distribution of mixture ratio of the conjugated fiber which shows a gradual decrease from the inner part toward the outer part of the liner will increase the number of heat bondings of fibers with each other in a dot or in a line successively toward the inner part, and thus enables simultaneous fulfillment of two functions of improving the form stability of the liner and of preventing the adverse effect of the conjugated fiber on the disk.

The state of distribution of the conjugated fiber in the liner according to the present invention will be illustrated with reference to FIG. 2. The points a and b on the ordinate axis in the Figure represent the points of intersection of the surface and the back of the non thermocompression-bonded part in FIG. 1 with the line x—x', respectively. As shown in the Figure, the maximum value of the mixture ratio of the conjugated fiber may be present in any of the positions given by the distribution 101, wherein the maximum is present at the central part of the liner, the distribution 102, wherein it is present at a part near the back of the liner, and the distribution 104, wherein it is present at a part near the surface of the liner. From the viewpoint of decreasing the influence on the disk, the maximum value of the mixture ratio is preferably present at the central part of the liner or at a part which is near to the back of the liner.

The maximum value of the mixture ratio of conjugated fiber should be sufficient for exhibiting a satisfactory form stability of the liner, and is preferably 20% or more.

It is also allowable that the maximum value represents a place composed of conjugated fiber alone as in the distribution 103. Further, as shown in the distributions 101, 102, 103, 104, 105 and 106 the mixture ratio of conjugated fiber may be similar both at the surface and at the back of the liner or, as shown in the distribution 107, a difference may be provided in the mixture ratio of conjugated fiber between the surface and the back of the liner.

A mixture ratio of conjugated fiber of 10% or more at the liner surface should be avoided because it gives rise to risk of causing damage of the disk surface by the conjugated fiber.

The conjugated fiber used as the binder fiber in the liner of the present invention is a polyester, core-sheath type conjugated fiber wherein the melting point of the sheath component is lower than that of the core component. Such a fiber itself is well known to those skilled in the art.

The binder fiber should basically comprise a hydrophobic resin. For example, nylon-6 fibers, although excellent in heat-bonding property with cellulosic fibers, are on the same level as cellulosic fibers as regards the degree of swelling by water. Accordingly, nylon-6 fibers having such humidity dependency give only a poor form stability to temperature and humidity even when a large number of places heat-bonded in a dot or in a line are present in the non thermocompression-bonded part.

As examples of fibers which have little dependency on temperature and humidity and good adhesive property with cellulosic fibers, mention may be made of low melting point polyester fiber and polypropylene fiber. These fibers, however, are not preferable because they are liable to form melt beads in heat bonding with non-thermoplastic fibers, leading to the risk of falling off of the beads.

The ratio of the core part to the sheath part in the core-sheath type conjugated fiber used in the present invention may be selected according to the intended object. In the present invention, the conjugated fiber is used to serve for hot melt bonding (namely, heat bonding of the partially thermocompression-bonded part and the non thermocompression-bonded part of the liner) and, at the same time, is required to retain the form of fiber even after the melt bonding. When viewed from such a point, the ratio is preferably in the range from 1:3 to 3:1.

The fiber used in admixture with the conjugated fiber in the present invention needs to be excellent in the function of cleaning the disk surface, to give no damage to the disk surface, and not to stick to the surface. From these viewpoints cellulosic fibers are suitable and particularly rayon fibers ar preferable. Suitable rayon fibers include, for example, titanium oxide-containing rayon fiber, bright rayon fiber containing no titanium oxide, and polynosic fiber, and may be selected in relation to the kind of disks.

The process for producing the floppy disk liner according to the present invention will be described below.

Figure 4:
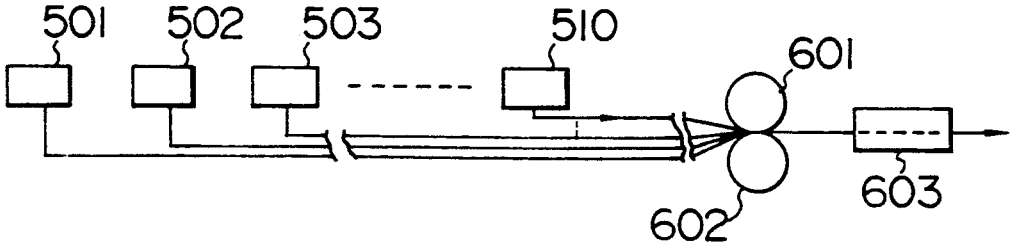
FIG. 4 is a flow diagram showing an example of the process for producing the liner according to the present invention.

FIG. 4 is a schematic flow diagram showing the process for producing the liner of the present invention.

Webs are formed by using plural carding engines 501, 502, 503, . . . , 510 and then passed via. thermocompression bonding rollers (embossing rollers) 601 and 602 through a heating zone 603.

A series of fiber mixtures in which the mixture ratio of a conjugated fiber to a cellulosic fiber is successively increased are respectively charged into the carding engines 501, 502, 503, 504 and 505. Into the carding engines on and after 506, are charged fiber mixtures in which the proportion of the conjugated fiber is successively decreased, respectively. The webs delivered from the respective carding engines are piled up successively and then processed through the thermocompression bonding rollers 601 and 602 to form partially thermocompression-bonded parts.

At this time, an irregular surface is formed at least with the thermocompression bonding roller 602, and the web surface which has contacted with the thermocompression bonding roller 602 is made to serve as the face which will contact with the disk (the surface) of the liner.

When the thermocompression bonding roller 601 is made to have a flat surface and is used so as to give the back of the liner, the thermal efficiency of the thermocompression bonding roller for the web is enhanced, and heat-bonded parts formed in a dot or in a line through conjugated fiber in the non thermocompression-bonded part are more readily developed in a large number. It is of course possible, in order to develop a still large number of heat-bonded parts in the form of dot or line in the non thermocompression-bonded part, to pass the web through heating equipment such as a tenter, for example. Only when fiber mixtures with varied mixture ratio of conjugated fiber to cellulosic fiber are charged into a number of carding engines as in the above-described method, the formation of the liner of the present invention having a distribution of the mixture ratio of conjugated fiber becomes possible. It is needless to say that the number of carding engines used may be increased or decreased in relation to the weight per unit area and the thickness required for the liner.

The present invention will be described further in detail below with reference to the Drawings.

EXAMPLE 1

A titanium oxide-containing rayon fiber (1.5 d×51 mm) was used as the cellulosic fiber and a polyester, core-sheath type conjugated fiber (2.0 d×51 mm, core part/sheath part=1/1, core part melting point: 265° C., sheath part melting point: 110° C.) was used as the conjugated fiber. Seven carding machines were provided. Into the 1st and the 7th carding engines was fed a fiber comprising 100% of the rayon fiber, into the 2nd and the 6th carding engine a fiber mixture comprising 90% of the rayon fiber and 10% of the polyester, core-sheath type conjugated fiber, into the 3rd and the 5th carding engine a fiber mixture comprising 70% of the rayon fiber and 30% of the polyester, core-sheath type conjugated fiber, and into the 4th carding engine a fiber mixture comprising 50% of the rayon fiber and 50% of the polyester, coresheath type conjugated fiber. The webs delivered from the respective carding engines were piled up successively, subsequently subjected to thermocompression bonding using thermocompression bonding rollers (one roll having an irregular surface and the other roll having a flat surface) at a roller temperature of 220° C. and then treated with a tenter at 180° C. (retention time : 1 minute) to obtain a nonwoven fabric for a liner.

The nonwoven fabric thus obtained was tested for its form stability to environmental changes. The results of the test are as shown in Table 1.

TABLE 1

| | |
|---|---|
| Fabric thickness increase percentage | 6% |
| Shrinkage percentage | |
| Longitudinal direction | 1% |
| Lateral direction | 0% |

Form stability test:

Form stability was examined after standing at 23° C. and 60% RH for 3 hours and further standing at 60° C. and 90% RH for 3 hours.

Under the same environmental conditions as in the form stability test, a torque test (see Note 1 below) was made by using a 3.5" floppy disk. The change in torque was found to be only an increase of about 0.8 g·cm relative to the initial setting of 12 g·cm.

Further, an actual run $10^7$ pass test (see Note 2 below) was conducted by using the same 3.5" floppy disk and the disk surface was inspected. Resultantly, no damage nor sticking matter was observed and the appearance of the disk surface was similar to that in the initial stage.

The cross section of the nonwoven fabric was inspected with an electron microscope. It was recognized that a large number of heat-bonded parts in the form of dot or line were present in the non thermocompression-bonded part inside the nonwoven fabric.

Note 1 : Torque test

The liner was fitted to a 3.5" floppy disk and the jacket was fabricated. Then, determination was made by using a rotatory torquemeter at a number of revolution of 360 r.p.m,. and the value of torque 5 minutes after the initiation of the determination was read.

Note 2 : Actual run $10^7$ pass test

This is a test for evaluation of durability, and is a continuous test conducted under the conditions of a number of revolution of 360 r.p.m., a torque setting of 12 g·cm and an environment of 23° C.×60% RH until the cumulative number of revolutions reached $10^7$.

EXAMPLE 2

The same materials as in Example 1 were used respectively as the cellulosic fiber and the conjugated fiber. Seven carding engines were provided. Into the 1st and the 7th carding engines was fed a fiber comprising 100% of the rayon fiber, into the 2nd and the 6th carding engines a fiber mixture comprising 90% of the rayon fiber and 10% of the polyester, core-sheath type conjugated fiber, and into the 3rd, the 4th and the 5th carding engines a fiber mixture comprising 50% of the rayon fiber and 50% of the polyester, core-sheath type conjugated fiber. The webs delivered from the respective carding engines were piled up successively and then subjected to thermocompression bonding treatment using the thermocompression bonding rollers employed in Example 1, the temperature of the roll having an irregular surface being set at 200° C. and the temperature of the roll having a flat surface being set at 240° C.

The nonwoven fabric thus obtained was tested for its form stability to environmental changes similar to those in Example 1. The results of the test are as shown in Table 2.

TABLE 2

| | |
|---|---|
| Fabric thickness increase percentage | 18% |
| Shrinkage percentage | |
| Longitudinal direction | 1% |
| Lateral direction | 0% |

A torque test was made in the same manner as in Example 1. The change in torque was found to be only an increase of about 1.5 g·cm relative to the initial setting of 12 g·cm.

Further, an actual run $10^7$ pass test was conducted in the same manner as in Example 1. No change was observed on the disk surface.

Inspection of the cross section of the nonwoven fabric by electron microscope revealed that a large number of heat-bonded parts in the form of dot or line were present in the non thermocompression-bonded part inside the nonwove fabric.

EXAMPLE 3

The same material as in Example 1 was used as the conjugated fiber, and a polynosic fiber (1.5 d×51 mm) was used as the cellulosic fiber. Seven carding engines were provided. Into the 1st and the 7th carding engines was fed a fiber comprising 100% of the polynosic fiber, into the 2nd and the 6th carding engines a fiber mixture comprising 90% of the polynosic fiber and 10% of polyester, core-sheath type conjugated fiber, and into the 3rd, the 4th and the 5th carding engines a fiber mixture comprising 50% of the polynosic fiber and 50% of the polyester, core-sheath type conjugated fiber. The webs delivered from the respective carding engines were piled up successively and then subjected to thermo-compression bonding treatment under the same conditions as in Example 2.

The nonwoven fabric thus obtained was tested for its form stability to environmental changes similar to those in Example 1. The results of the test are as shown in Table 3.

TABLE 3

| | |
|---|---|
| Fabric thickness increase percentage | 18% |
| Shrinkage percentage | |
| Longitudinal direction | 1% |
| Lateral direction | 0% |

A torque test was made in the same manner as in Example 1. The change in torque was found to be only an increase of about 1.2 g·cm relative to the initial setting of 12 g·cm.

Further, an actual run $10^7$ pass test was conducted in the same manner as in Example 1. No change developed on the disk surface.

Inspection of the cross section of the nonwoven fabric by electron microscope revealed that a large number of heat-bonded parts in the form of dot or line were present in the non thermocompression-bonded part inside the nonwoven fabric.

Comparative Example 1

A nonwoven fabric was formed under the same conditions as in Example 1 except that the temperature of the thermocompression bonding roller was changed to 200° C. and the fabric was not passed through a tenter. The nonwoven fabric showed no heat-bonded place in the form of dot or line in the non thermocompression-bonded part.

The nonwoven fabric was tested for its form stability to environmental changes similar to those in Example 1. The results of the test are as shown in Table 4.

TABLE 4

| | |
|---|---|
| Fabric thickness increase percentage | 42% |
| Shrinkage percentage | |
| Longitudinal direction | 1% |
| Lateral direction | 0% |

Further, a torque test was made in the same manner as in Example 1. The change in torque amounted to an increase of about 5 g·cm relative to the initial setting of 12 g·cm.

Comparative Example 2

The same materials as used in Example 1 were employed. Seven carding engines were provided. For the 1st, the 2nd, the 6th and the 7th carding engines was used a fiber comprising 100% of the rayon fiber, and for the 3rd, the 4th and the 5th carding engines a fiber mixture comprising 50% of the rayon fiber and 50% of the polyester, core-sheath type conjugated fiber. The webs delivered from the respective carding engines were piled up successively to form a web aggregate having a distinct lamination structure, and then subjected to thermocompression bonding treatment by using the thermocompression bonding rollers employed in Example 1, the temperature of the roll having an irregular surface being set at 180° C. and the temperature of the roll having a flat surface at 220° C.

The nonwoven fabric thus obtained was tested for its form stability to environmental changes. The results of the test are as shown in Table 5.

TABLE 5

| | |
|---|---|
| Fabric thickness increase | 49% |

TABLE 5-continued

| percentage | |
|---|---|
| Shrinkage percentage | |
| Longitudinal direction | 1% |
| Lateral direction | 0% |

A torque test was made in the same manner as in Example 1. The change in torque was found to be an increase of as large as about 8 g·cm relative to the initial setting of 12 g·cm.

Further, in the actual run $10^7$ pass test conducted in the same manner as in Example 1, falling off phenomena of the rayon fiber constituting the liner surface were observed in a large number.

The cross section of the nonwoven fabric was inspected with an electron microscope. No thermally bonded part was observed in the non thermocompression-bonded part inside the nonwoven fabric.

COMPARATIVE EXAMPLE 3

A titanium oxide-containing rayon fiber (1.5 d×51 mm) was used as the cellulosic fiber and a nylon-6 fiber (2 d×51 mm) as the binder thermoplastic fiber. Seven carding engines were provided. Into the 1st, the 2nd, the 6th and the 7th carding engines was fed a fiber comprising 100% of the rayon fiber, and into the 3rd, the 4th and the 5th carding engines a fiber mixture comprising 50% of the rayon fiber and 50% of the nylon-6 fiber. The webs delivered from the respective carding engines were piled up successively to form a web laminate having a distinct lamination structure, which was succeedingly subjected to thermocompression bonding treatment under the same conditions as in Example 2 to form a nonwoven fabric.

The nonwoven fabric thus obtained was subjected to a torque test in the same manner as in Example 1. It was found that the torque increased by as much as 8 g·cm relative to the initial setting of 12 g·cm.

The nonwoven fabric (i.e., liner) after the torque test showed development of a large number irregular wrinkles due to the elongation of the nonwoven fabric.

EFFECT OF THE INVENTION

As described above, in the liner according to the present invention, the polyester, core-sheath type conjugated fiber used as the binder fiber is hydrophobic, the form of the fiber is retained even after heat treatment, the conjugated fiber is distributed such that its proportion decreases gradually from the inner part toward the outer part of the liner, and moreover a large number of parts heat-bonded in a dot or in a line are present also in the non thermocompression-bonded part. Accordingly, the liner is excellent in form stability to environmental (temperature and humidity) changes and, owing to the so-called pantograph effect, retains its elasticity against a load (applied by a lifter in the case of a 3.5" floppy disk and by a pressure pad in the case of a 5.25" and 8" floppy disk) even after used for a long time, thereby exhibiting an excellent cleaning property for a long time. Further, the liner shows a good cutting processability in fabrication of the floppy disk and develops little of flash and fluff. Moreover, no melt bead is formed in heat bonding unlike in the use of a binder fiber composed of a single component. Thus, the present invention is of area industrial significance.

What is claimed is:

1. A liner for a floppy disk jacket comprising a nonwoven fabric composed of a cellulosic fiber and a polyester core-sheath type conjugated fiber having a core component and a sheath component, said sheath component having a lower melting point than said core component, said nonwoven fabric having thermocompression-bonded parts and nonthermocompression-bonded parts, and said liner having a surface, which is to make contact with said floppy disk jacket, and a back, which contacts a floppy disk within said floppy disk jacket, wherein said polyester core-sheath type conjugated fiber and said cellulosic fiber are mixed in a mixture ratio such that said mixture ratio of said polyester core-sheath type conjugated fiber to said cellulosic fiber gradually increases on moving from said surface and said back until a maximum value of said mixture ratio is reached at a location between said surface and said back, and said polyester core-sheath type conjugated fibers have a number of heat bondings in said nonthermocompression-bonded parts corresponding to said mixture ratio.

2. A liner for a floppy disk according to claim 1 wherein said mixture ratio of said polyester core-sheath type conjugated fiber to said cellulosic fiber at said surface of said liner is less than 10%.

* * * * *